US005524390A

United States Patent [19]

Christensen

[11] Patent Number: 5,524,390

[45] Date of Patent: Jun. 11, 1996

[54] JALOUSIE

[76] Inventor: Edwin N. Christensen, 5460 Kula Mauu St., Kappa, Hi. 96746

[21] Appl. No.: 320,221

[22] Filed: Oct. 11, 1994

[51] Int. Cl.[6] ..... E06B 3/32

[52] U.S. Cl. ..... 49/463; 49/169; 160/104

[58] Field of Search ..... 49/463, 465, 169, 49/171, 176, 62, 64; 160/104, 180

[56] References Cited

U.S. PATENT DOCUMENTS

| | | | |
|---|---|---|---|
| 1,238,703 | 8/1917 | Wendelken | 160/104 X |
| 2,063,546 | 12/1936 | Friedholdt, Jr. | 160/104 X |
| 2,636,558 | 4/1953 | Bauders, Jr. | 160/104 |
| 2,905,980 | 9/1959 | Mitchell | 49/169 X |
| 2,939,185 | 6/1960 | Ader et al. | 49/463 X |
| 3,468,058 | 9/1969 | Fontaine | 49/463 X |
| 5,067,278 | 11/1991 | Lyons | 49/463 |

*Primary Examiner*—Philip C. Kannan
*Attorney, Agent, or Firm*—Michael I. Kroll

[57] ABSTRACT

An improved jalousie comprising a casing built in a wall of a building. A structural framework is in the casing, while a louver fits into the structural framework. A component is for tilting the louver inwardly in the structural framework. The louver can be removed from the structural framework to be cleaned and replaced when needed.

4 Claims, 4 Drawing Sheets

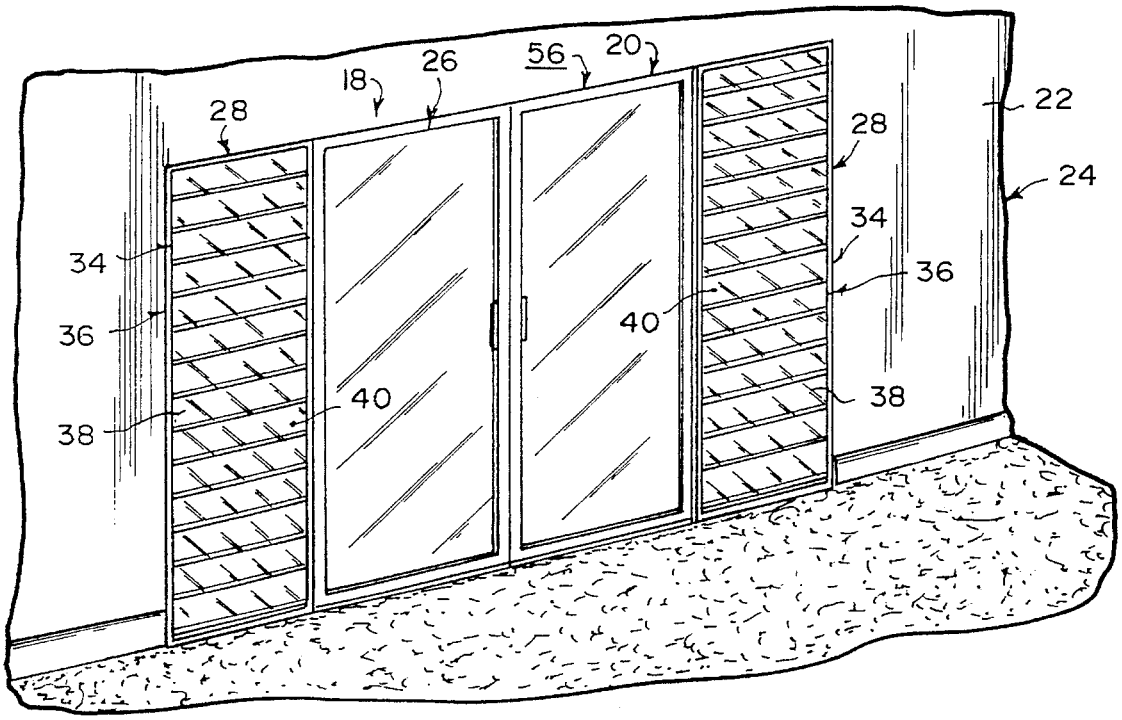
Fig 13
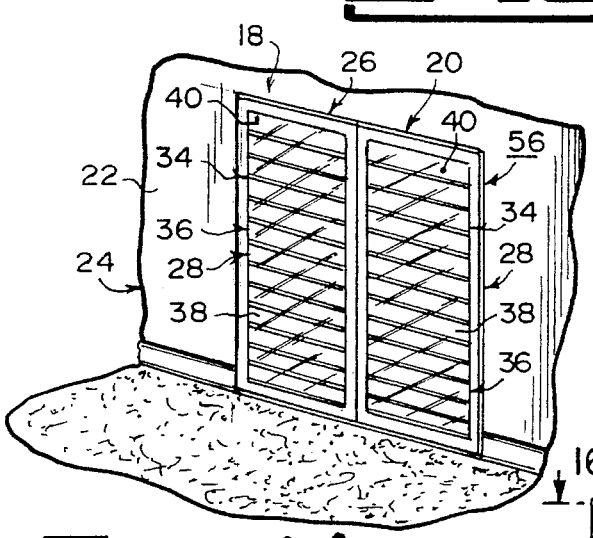
Fig 14
Fig 15
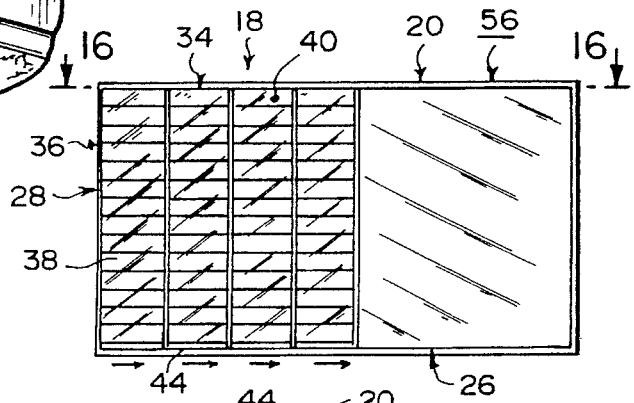
Fig 16
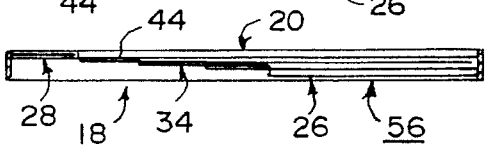

JALOUSIE

BACKGROUND OF THE INVENTION

1. Field of the Invention

The instant invention relates generally to window structures and more specifically it relates to an improved jalousie.

2. Description of the Prior Art

Numerous window structures have been provided in prior art. For example, U.S. Pat. Nos. 1,238,703 to Wendelken; 2,093,093 to Mongus; 2,542,146 to Kellogg and 3,039,155 to Iacovoni all are illustrative of such prior art. While these units may be suitable for the particular purpose to which they address, they would not be as suitable for the purposes of the present invention as heretofore described.

WENDELKEN, ALBERT C.

SASH

U.S. Pat. No. 1,238,703

A sash structure comprising the following instrumentalities. A sash frame with metal side strips for the frame. Metal cross strips at the top and bottom of the frame has their edges bent over to form horizontal flanges at top and bottom of the frame opening. A plurality of metal slats are each flanged at opposite ends, with its longitudinal edges turned in opposite directions, pivoted at one edge of each of its opposite end flanges to one of the metal side strips of the frame. A metal connecting strip is pivoted to the free edges of the flanges at each end of all of the slats. A common operating means is mounted on one side strip and is adapted to effect parallel motion of all the slats together. The upper and lower edges of each intermediate slat engages with and closes against the lower and upper edges respectively of the adjacent slats when all the slats are closed. The upper and lower edges of the upper and lower slats at such time engages with and closes against the flanges on the upper and lower cross metal strips at the top and bottom of the frame respectively. The entire area of the frame is tightly sealed when the slats are closed and the entire area is opened when the slats are opened.

MONGUS, WILLIAM M.

WINDOW STRUCTURE

U.S. Pat. No. 2,093,093

A shutter including slats which are individually mounted upon and supported solely by a pliable metallic means that provides for adjusting the inclinations of the slats through the horizontal to both upward and downward inclinations.

KELLOGG, BERTHA O.

VENETIAN BLIND STRUCTURE FOR WINDOWS

U.S. Pat. No. 2,542,146

In a Venetian blind structure for a window. The window has a screen and a frame therefor. The Venetian blind structure comprising a pair of spaced frame members vertically positioned. Each frame member consisting of a right angle leg and screws to secure the leg to the frame of the window. A web extends inwardly from the leg. A second right angle leg portion extends from the web in the same direction as the first leg. Another flange portion extends from the second leg portion and toward the frame of the window for contacting the screen. The second leg portion seals in spaced relation vertically. A plurality of horizontally positioned slats are carried by the second right angle leg portion. The slats have spindles on their ends to engage in the seats of the second right angle leg portions. A rod is vertically disposed intermediately between the ends of the slats. A hook is to secure one edge of each slat to the rod rockably. The rod at its lower end has a series of notches. A bracket is secured to a lower portion of the window frame. The lower end of the rod engages in the bracket, to retain the slats as selectively rocked on a horizontal line.

IACOVONI, VICTOR S.

AWING WINDOW

U.S. Pat. No. 3,039,155

An attachment for mounting on an awing-window sash comprising a pair of end supports having a front wall, a pair of side walls, a top wall and a bottom wall. A mounting tab extends from the top and bottom of each end support and is adapted to be fastened to a window sash. One of the side walls has a series of slots formed therein at an angle from the front wall. A plurality of slats are mounted between the pair of end supports in substantially parallel arrangement. The ends of the slats are located within the slots in the end supports and are positioned at an angle from the plane of the sash.

SUMMARY OF THE INVENTION

A primary object of the present invention is to provide an improved jalousie that will overcome the shortcomings of the prior art devices.

Another object is to provide an improved jalousie that contains a louver in a structural framework in a casing built into a wall of a building, in which the louver can be tilted inwardly and removed from the structural framework to be cleaned and replaced when needed.

An additional object is to provide an improved jalousie, in which the structural framework can be a window or a door, in which the louver can be used to regulate the passage of air into the building for ventilation purposes.

A further object is to provide an improved jalousie that is simple and easy to use.

A still further object is to provide an improved jalousie that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 13 is a perspective view of the instant invention, showing a pair of louvers on opposite sides of a pair of glass doors.

FIG. 14 is a perspective view of the instant invention, showing a pair of louvers, each located in one of a pair of doors.

FIG. 15 is a front view of the instant invention, showing a plurality of movable louvers in a sliding door on one side of a large stationary sash with a pane of glass.

FIG. 16 is a cross sectional view taken along line 16—16 in FIG. 15.

DETAILED DESCRIPTION OF THE PREFERRED EMBODIMENTS

Figure 11:
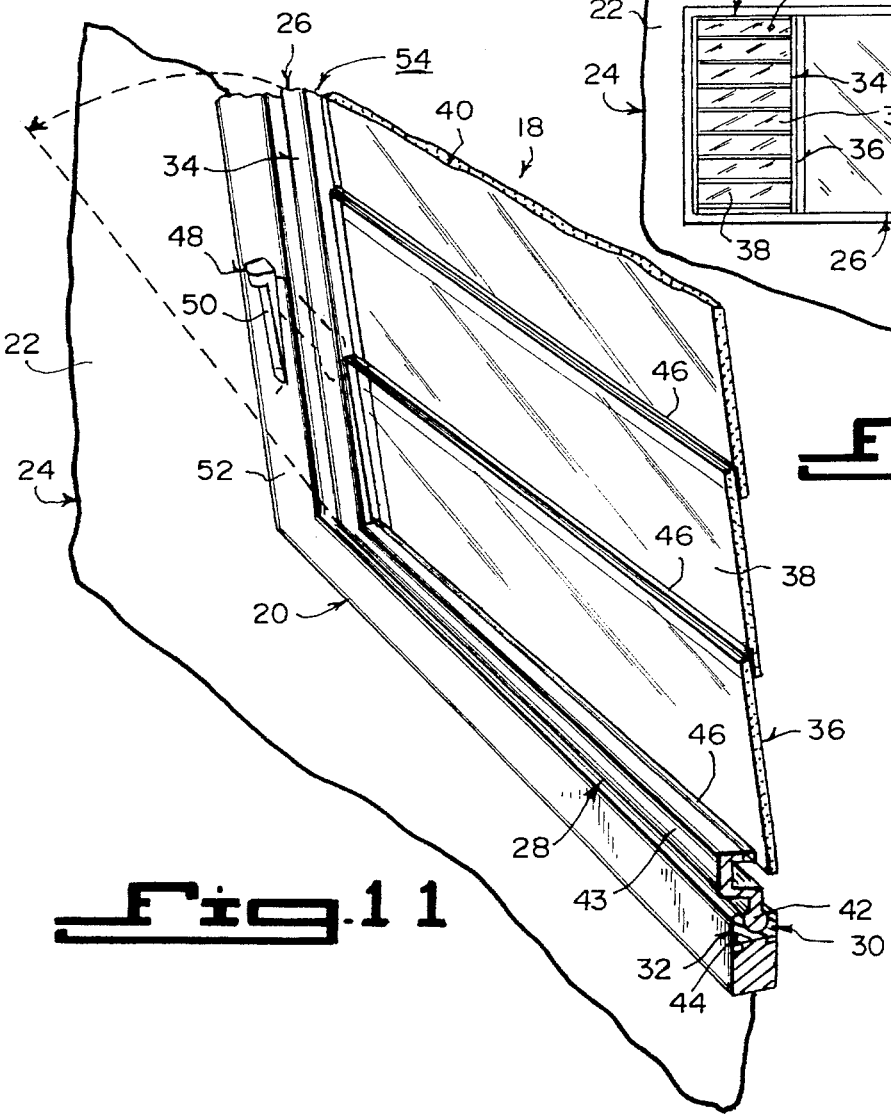
FIG. 11 is a perspective cross sectional view taken along line 11—11 in FIG. 6, showing the internal structure and weather strips between the slats in the louver.

Turning now descriptively to the drawings, in which similar reference characters denote similar elements throughout the several views, FIGS. 1 through 16 illustrate an improved jalousie 18, comprising a casing 20 built in a wall 22 of a building 24. A structural framework 26 is in the casing 20, while a louver 28 fits into the structural framework 26. A component 30, best seen in FIG. 11, is for tilting the louver 28 inwardly in the structural framework 26. The louver 28 can be removed from the structural framework 26, to be cleaned and replaced when needed.

The improved jalousie 10 further includes an element 32, for sliding the louver 28 in the structural framework 26, as best seen in FIG. 11. The louver 28 contains a sash 34. A plurality of slats 36 are positioned within the sash 34 in horizontal adjustable parallel arrangements, to regulate the passage of air into the building 24 for ventilation purposes.

Each slat 36 is a thin narrow flat rectangular strip 38. Each thin narrow flat rectangular strip 38 is fabricated out of a transparent material 40, to allow light to enter into the building 24. The transparent material 40 is glass.

The tilting component 30 is a hinge member 42 on a bottom rail 43 of the sash 34, to allow the sash 34 to tilt forward into the building 24 from the structural framework 26. The sliding element 32 is a track 44 built into the structural framework 26, to allow the hinge member 42 on the bottom rail 43 of the sash 26 to ride within the track 44.

A plurality of weather strips 46 are provided. Each weather strip 46 is between the abutting edges of the slats 36, to insulate when the slats 36 are closed during cold weather conditions, as shown in FIG. 11.

A pair of latch mechanisms 48 are also provided. Each latch mechanism 48 has a manually operable lock handle 50. Each latch mechanism 48 is located in a side jamb 52 of the casing 20. The lock handle 50 extends through an inner face 54 of the side jamb 52 of the casing 20. When the latch mechanisms 48 are placed in locked positions by the manual operation of the lock handles 50, the structural framework 26 with the louver 28 will be maintained in an upright position in the casing 20. (See FIGS. 6, 7, 8 and 11.)

The structural framework 26, as shown in FIGS. 1 through 12, is a window 54. The structural framework 26, in FIGS. 13 through 16 is a door 56.

Figure 5:
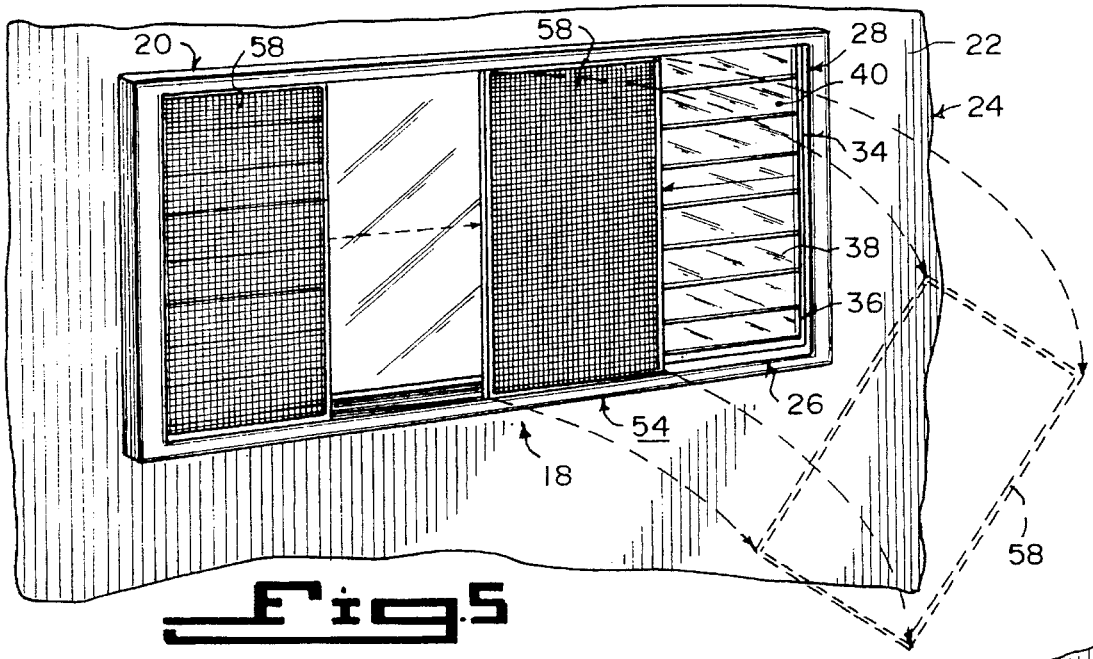
FIG. 5 is a perspective view similar to FIG. 1, with a pair of removable screens to cover the louvers when the louvers are opened.
Figure 6:
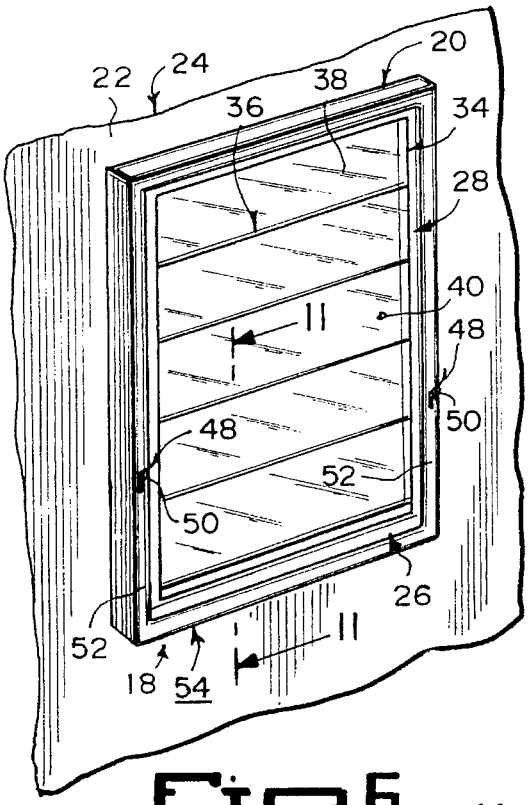
FIG. 6 is a perspective view of the instant invention, showing a single louver in a window with a pair of latch mechanisms, each in a side jamb of the casing.
Figure 7:
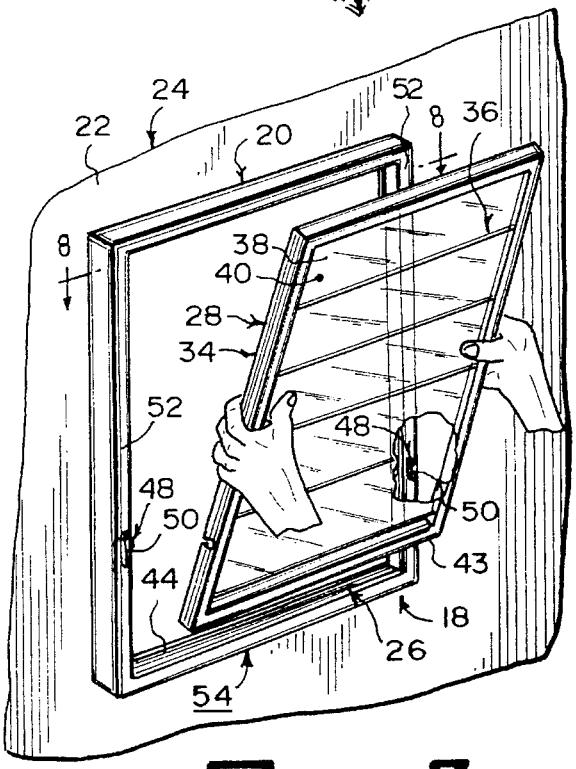
FIG. 7 is a perspective view similar to FIG. 6, showing the single louver being removed after tilting.
Figure 8:
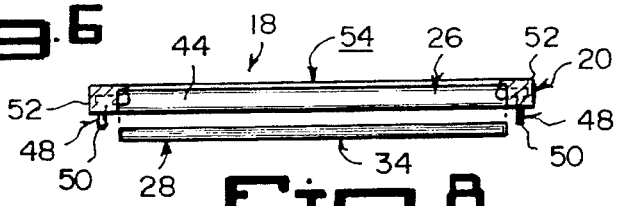
FIG. 8 is a cross sectional view taken along line 8—8 in FIG. 7.

Screens 58 can be used, as shown in FIG. 5. The screens 58 will cover the louvers 28, which can be opened in warm weather for ventilation. The screens 58 can slide and be removed into the building 24. The screens 58 can also pocket into the wall 2, if the casing 20 is so constructed to the wall 22.

Figure 1:
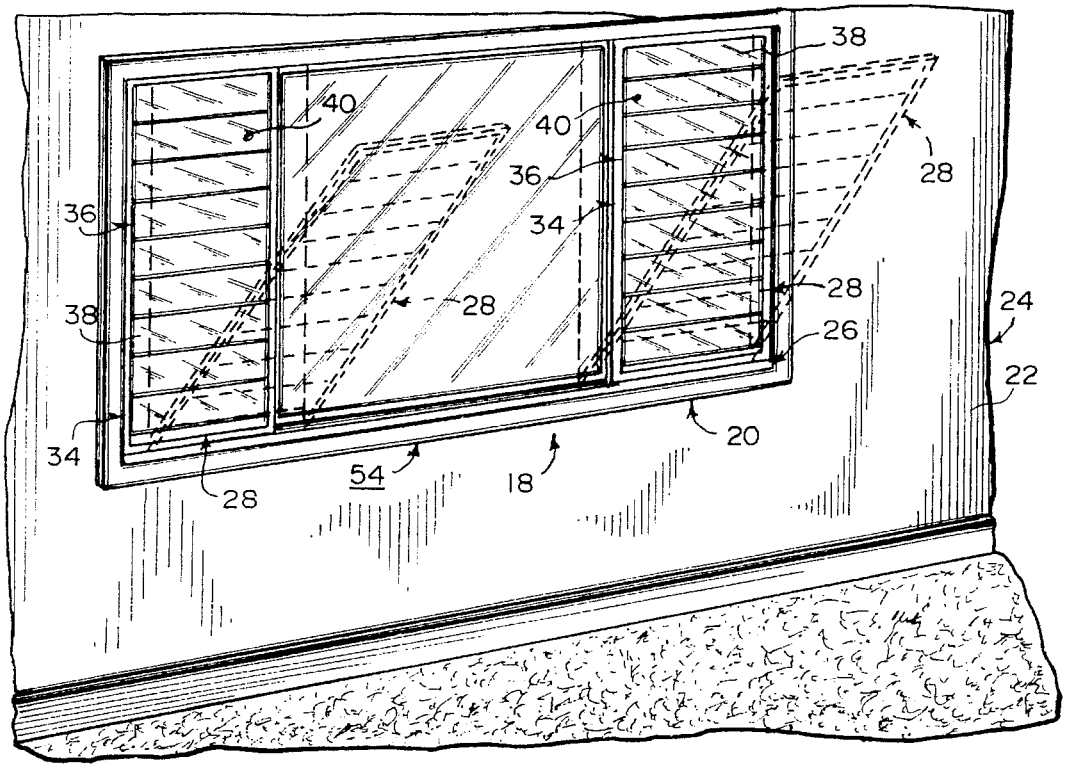
FIG. 1 is a perspective view of the instant invention, showing a pair of louvers in a window on both sides of a central stationary sash with a pane of glass.
Figure 2:
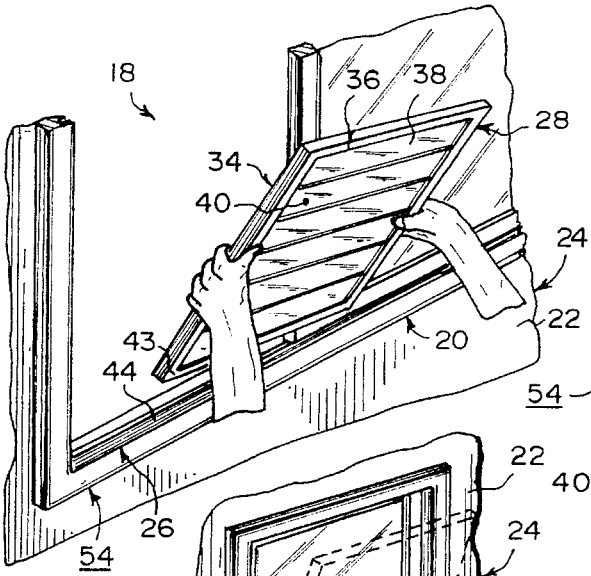
FIG. 2 is a perspective view of a portion of FIG. 1, showing one of the louvers being removed after tilting.
Figure 3:
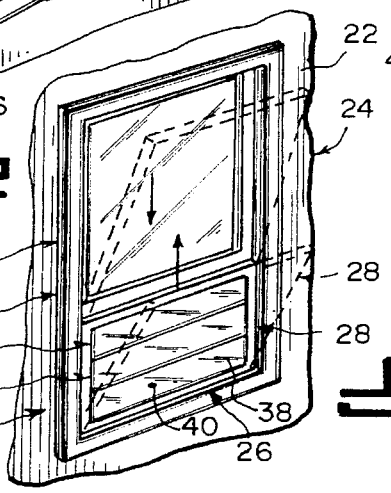
FIG. 3 is a perspective view of the instant invention, showing a louver as a small bottom sash in a double-hung window below a large sash with a pane of glass.
Figure 4:
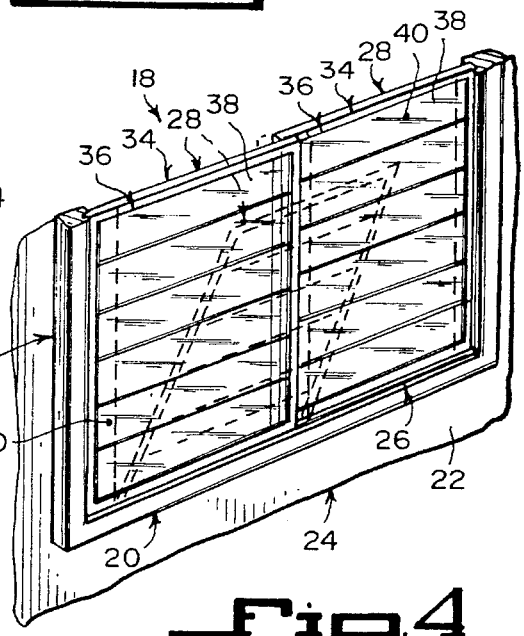
FIG. 4 is a perspective view of the instant invention with parts broken away showing a pair of movable louvers in a sliding window.
Figure 9:
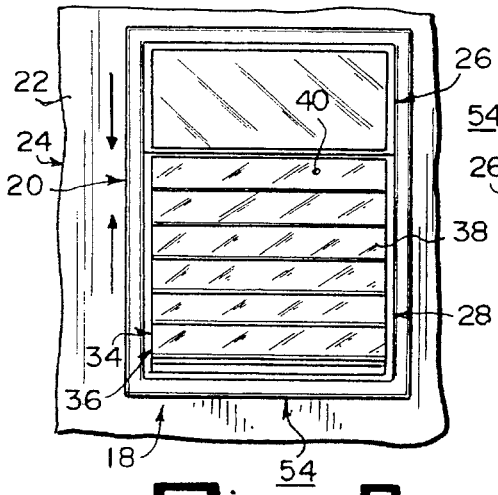
FIG. 9 is a front view of the instant invention, showing a louver as a large bottom sash in a double-hung window below a small sash with a pane of glass.
Figure 10:
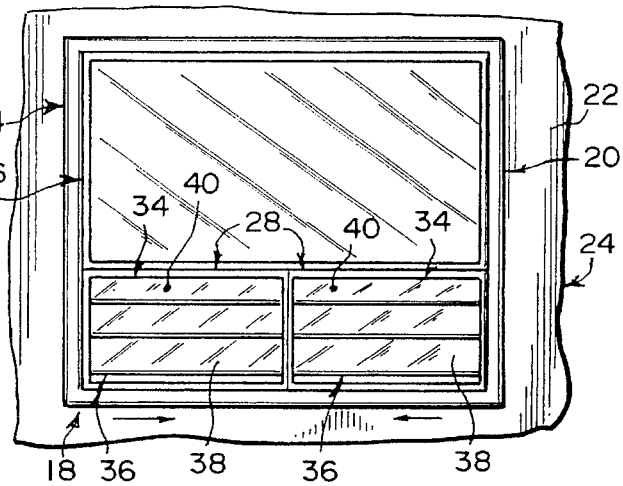
FIG. 10 is a front view of the instant invention, showing a pair of louvers in a window below an upper large stationary sash with a plane of glass.
Figure 12:
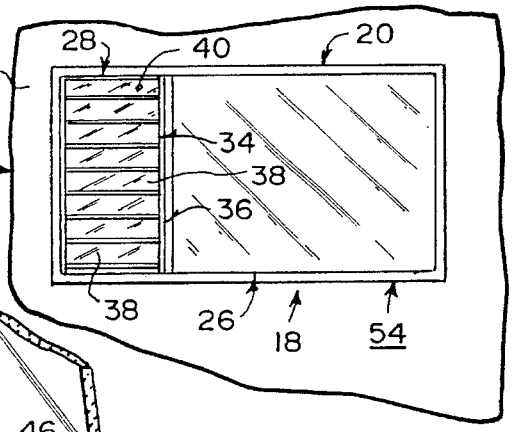
FIG. 12 is a front view of the instant invention, showing a single louver in a window on one side of a large stationary sash with a plane of glass.

In the windows 54, the louvers 28 can slide back and fourth in the track 44, as shown in FIGS. 1, 2, 4, 5, 10 and 12. The louvers 28 can slide up and down in the track 44, as shown in FIGS. 3 and 9. The louvers 28 are stationary in FIGS. 6, 7, 8 and 11.

In the doors 56, the louvers 28 are stationary, as shown in FIGS. 13 and 14. The louvers 28 can slide back and fourth in the track 44 in FIGS. 15 and 16.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved jalousie comprising:

a) a casing built in a wall of a building;

b) a structural framework in said casing;

c) a louver comprising a sash and a plurality of thin, narrow, flat rectangular slats of transparent glass material positioned within said sash in horizontal adjustable parallel arrangements to regulate the passage of air into the building for ventilating purposes to fit into said structural framework and means for sliding said louver in said structural framework; and d) means for tilting said louver inwardly in said structural framework, so that said louver can be removed from said structural framework to be cleaned and replaced when needed, said tilting means consisting of a hinge member on a bottom rail of said sash to allow said sash to tilt forward into the building from said structural framework, said sliding means consisting of a track built into said structural framework to allow said hinge member on the bottom rail of said sash to ride within said track.

2. An improved jalousie as recited in claim 1, further including a plurality of weather strips, with each said weather strip between the abutting edges of said slats, to insulate when said slats are closed during cold weather conditions.

3. An improved jalousie as recited in claim 2, wherein said structural framework is a window.

4. An improved jalousie as recited in claim 2, wherein said structural framework is a door.

* * * * *